US010316585B1

(12) United States Patent
Parker

(10) Patent No.: US 10,316,585 B1
(45) Date of Patent: Jun. 11, 2019

(54) STRAND GRAB AND LADDER INCLUDING THE SAME

(71) Applicant: WERNER CO., Greenville, PA (US)

(72) Inventor: Tom Parker, Jamestown, PA (US)

(73) Assignee: WERNER CO., Greenville, PA (US)

( * ) Notice: Subject to any disclaimer, the term of this patent is extended or adjusted under 35 U.S.C. 154(b) by 0 days.

(21) Appl. No.: 15/852,215

(22) Filed: Dec. 22, 2017

(51) Int. Cl.
*E04G 5/02* (2006.01)
*E06C 7/48* (2006.01)
*E06C 1/06* (2006.01)

(52) U.S. Cl.
CPC . *E06C 7/48* (2013.01); *E06C 1/06* (2013.01)

(58) Field of Classification Search
CPC . E06C 7/48; E06C 7/188; E06C 7/486; E06C 1/06
See application file for complete search history.

(56) References Cited

U.S. PATENT DOCUMENTS 1,393,048 A 10/1921 Stiles
3,910,380 A * 10/1975 Nameche ..... E06C 1/34 182/206
4,018,301 A * 4/1977 Nameche ..... E06C 1/34 182/206
5,054,581 A * 10/1991 Henson ..... E06C 1/36 182/206
6,044,930 A * 4/2000 Hayman ..... E06C 1/34 182/107
7,134,525 B1 * 11/2006 Ferris ..... E06C 7/486 182/107
7,219,766 B2 5/2007 Deuer
9,168,402 B2 10/2015 Casebolt et al.
9,382,759 B2 * 7/2016 Bolinski ..... E06C 7/188
9,404,306 B2 8/2016 Russell et al.
9,593,531 B2 3/2017 Ballard et al.
2003/0188924 A1 10/2003 Bamber
2014/0166397 A1 6/2014 Reynolds
2014/0251730 A1 9/2014 Bisset
2015/0353319 A1 12/2015 Henderson et al.
2016/0108670 A1 4/2016 Youlyahshiev
2016/0115737 A1 4/2016 O'Donnell et al.
2017/0022760 A1 1/2017 Egress
2017/0030142 A1 2/2017 Russell et al.

FOREIGN PATENT DOCUMENTS

JP 2012-140811 A 7/2012
WO WO-2018018116 A1 * 2/2018 ..... E06C 7/18

* cited by examiner

*Primary Examiner* — Jerry E Redman
(74) *Attorney, Agent, or Firm* — Eckert Seamans Cherin & Mellot, LLC

(57) ABSTRACT

A strand grab includes a frame including a mounting portion and a hook portion having a first end attached to the mounting portion and extending in an arc shape to a second end, a gate member rotatably attached to the mounting portion, a jaw member rotatably attached to the mounting portion, and a connector member coupled between the gate member and the jaw member. The gate member, the jaw member, and the connector member are operatively coupled such that when the gate member rotates toward the first end of the hook portion, the connector member causes the jaw member to rotate toward the first end of the hook portion.

19 Claims, 19 Drawing Sheets

STRAND GRAB AND LADDER INCLUDING THE SAME

BACKGROUND

Field

The disclosed concept relates generally to ladders, and in particular, to a strand grab for use with a ladder.

Background Information

Safety is important when using ladders. When using a ladder in conjunction with a flat side of a building, leaning the ladder against the side of the building is generally considered safe enough for use. In other applications though, a flat surface may not be available to lean the ladder against.

Ladders are often used in applications where they are leaned against a strand such as a rope or wire. For example, ladders are often leaned against a strand of wire between two utility poles. The ladder can have a tendency to slide along the length of the strand. The strand itself may also move. Movement of the ladder or the strand can create an unsafe situation. As such, supplemental equipment should be used to secure the ladder to the strand so that it may be used safely. Any supplemental equipment that is employed should be practical and convenient to use.

Some solutions use a hook attached to a ladder to hook onto the strand in case the base of the ladder slides out or the strand deflects away from the ladder. However, the ladder still has the tendency to slide along the length of the strand. Additionally, a bouncing motion or a severe deflection could cause the strand to slide out from under the hook and allow the ladder to fall. There is room for improvement in equipment for securing ladders to strands.

SUMMARY

These needs and others are met by embodiments of the disclosed concept in which a strand grab for use with a ladder includes gate member and a jaw member that rotates upward with the gate member to grab a strand.

In accordance with aspects of the disclosed concept, a strand grab for use with a ladder comprises: a frame including a mounting portion and a hook portion having a first end attached to the mounting portion and extending in an arc shape to a second end; a gate member rotatably attached to the mounting portion of the frame at a first pivot; a jaw member rotatably attached to the mounting portion of the frame at a second pivot; a connector member coupled between the gate member and the jaw member, wherein the gate member is rotatable between a first position proximate the second end of the hook portion and a second position proximate the first end of the hook portion, wherein the gate member is structured to rotate from the first position toward the first end of the hook portion when the strand grab is lowered onto a strand such that the strand applies a force against the gate member, and wherein the gate member, the jaw member, and the connector member are operatively coupled such that when the gate member rotates toward the first end of the hook portion, the connector member causes the jaw member to rotate toward the first end of the hook portion.

In accordance with other aspects of the disclosed concept, a ladder comprises: a pair of rails; a pair of rungs extending between the rails; a mounting piece attached between the pair of rungs; and a strand grab rotatably attached to the mounting piece, the strand grab including: a frame including a mounting portion and a hook portion having a first end attached to the mounting portion and extending in an arc shape to a second end; a gate member rotatably attached to the mounting portion of the frame at a first pivot; a jaw member rotatably attached to the mounting portion of the frame at a second pivot; a connector member coupled between the gate member and the jaw member, wherein the gate member is rotatable between a first position proximate the second end of the hook portion and a second position proximate the first end of the hook portion, wherein the gate member is structured to rotate from the first position toward the first end of the hook portion when the strand grab is lowered onto a strand such that the strand applies a force against the gate member, and wherein the gate member, the jaw member, and the connector member are operatively coupled such that when the gate member rotates toward the first end of the hook portion, the connector member causes the jaw member to rotate toward the first end of the hook portion.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
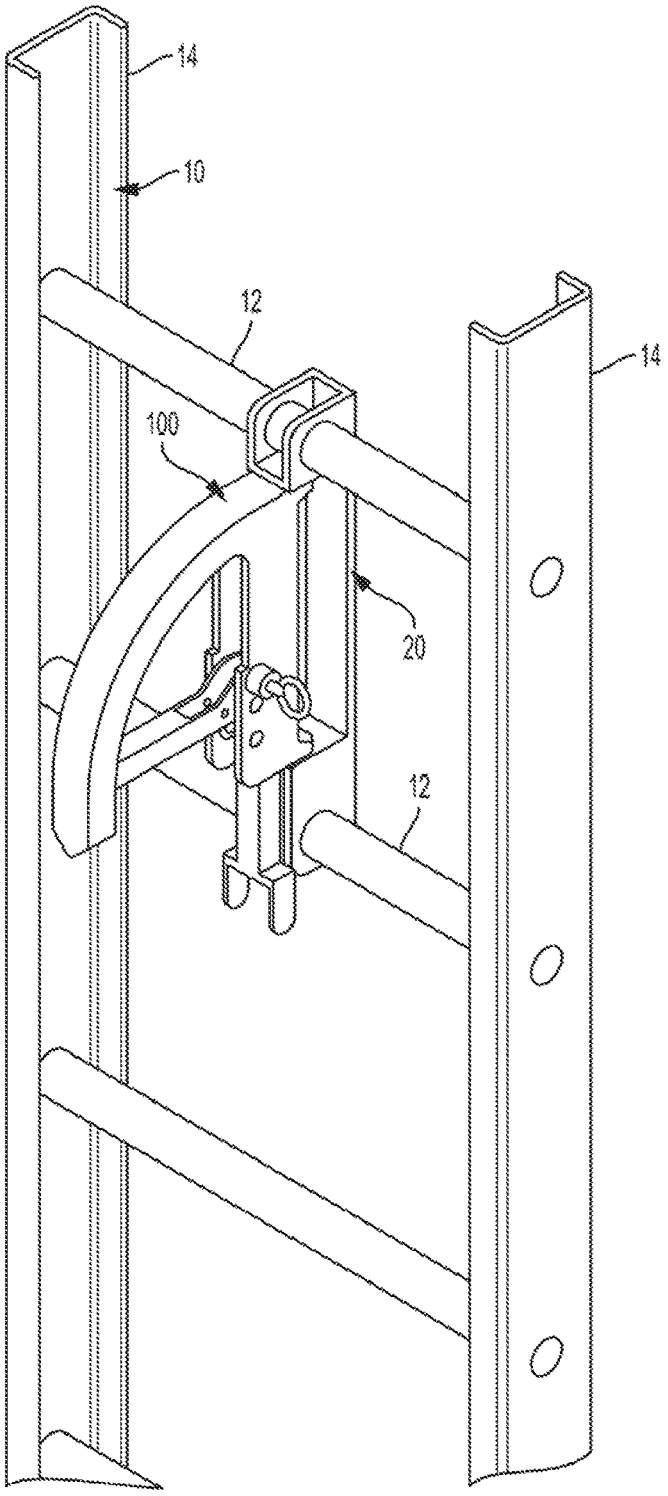
FIG. 1 is a view of a ladder with a strand grab in a deployed position in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

Figure 2:
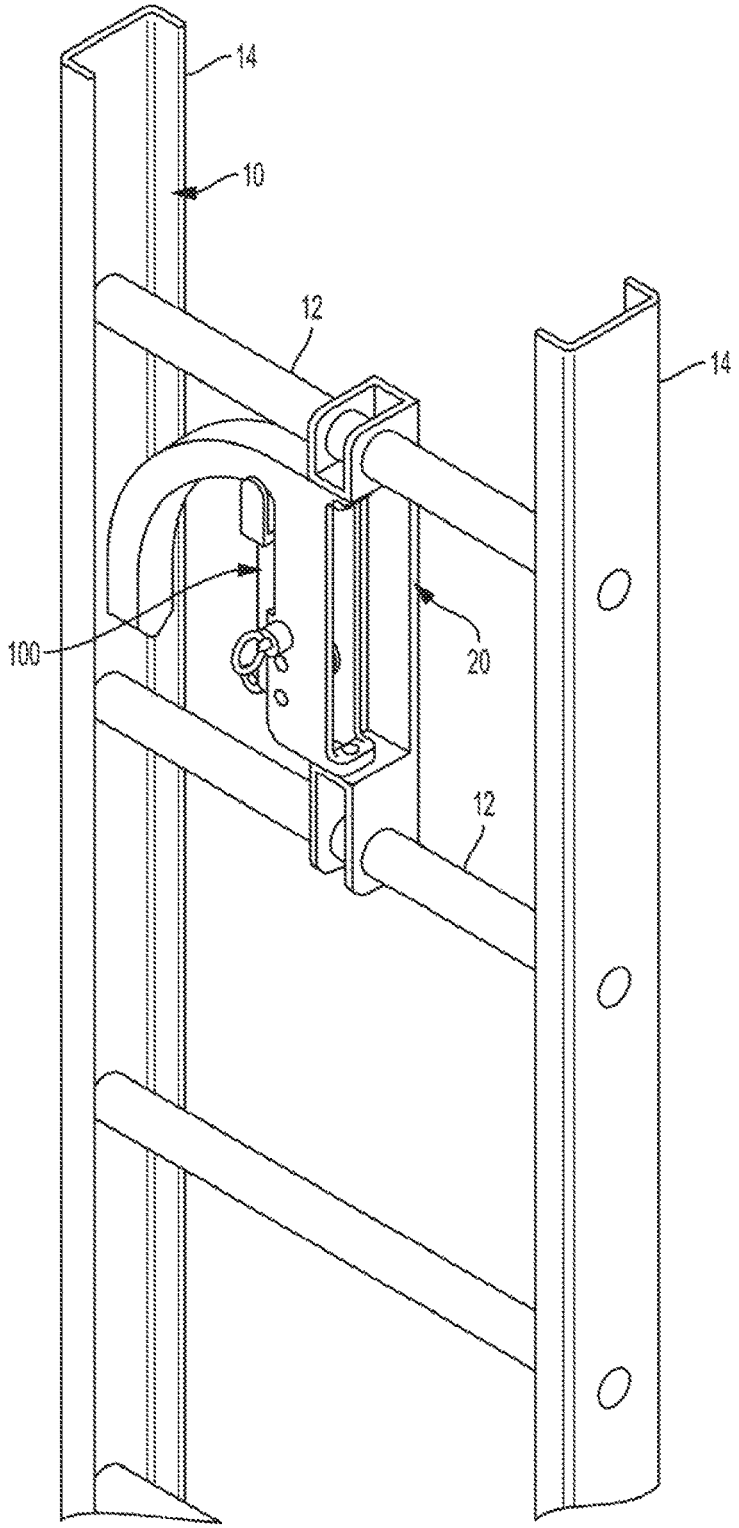
FIG. 2 is a view of a ladder with a strand grab in a stowed position in accordance with an example embodiment of the disclosed concept.

FIG. 1 is a view of a ladder 10 with a strand grab 100 attached to its top portion in accordance with an example embodiment of the disclosed concept. FIG. 2 is an additional view of the ladder 10 and the strand grab 100 of FIG. 1. A mounting piece 20 is attached to two adjacent rungs 12 of the ladder 10. The strand grab 100 is rotatably attached to the mounting piece 20.

In FIG. 1, the strand grab 100 is in a deployed position. In the deployed position, the strand grab 100 extends outward in a direction perpendicular with respect to the width of the ladder 10, as is shown in FIG. 1. In FIG. 2, the strand grab 100 is in a stowed position. In the stowed position, the strand grab 100 extends in a direction parallel with respect to the width of the ladder 10, as is shown in FIG. 2. In some example embodiments of the disclosed concept, in the stowed position, the strand grab 100 does not extend beyond a depth of rails 14 of the ladder 10. The strand grab 100 is structured to rotate between the deployed position and the stowed position.

Figure 12:
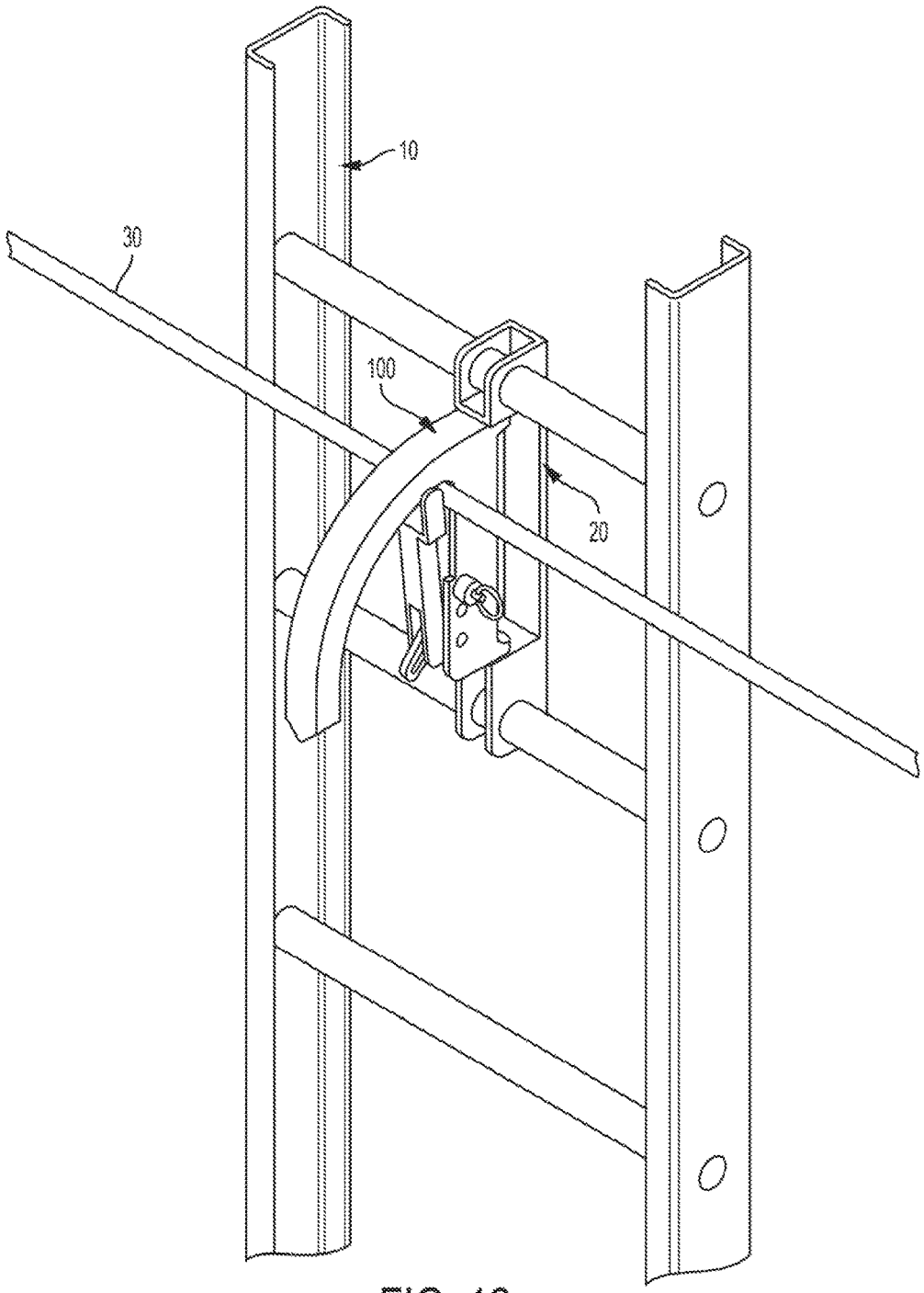
FIG. 12 is an isometric view of a strand grab secured to a strand in accordance with an example embodiment of the disclosed concept.

The strand grab 100 is used for securing the ladder 10 to a strand 30 (see FIG. 12). The strand grab 100 grabs onto the strand to prevent the ladder 10 from sliding along the strand 30. The strand grab 100 is also hooked onto the strand 30 which keeps the ladder 10 attached to the strand 30 if the base of the ladder 10 slides out or the strand 30 deflects away from the ladder 10. The strand grab 100 is structured such that it will only release the strand 30 upon deliberate action by a user to cause its release. In some example embodiments of the disclosed concept, the strand grab 100 is structured to secure the ladder 10 to strands having diameters in the range of about ⅝" to about 4". However, it will be appreciated that disclosed concept also includes strand grabs 100 capable of securing the ladder 10 to strands having other diameters as well.

Figure 3:
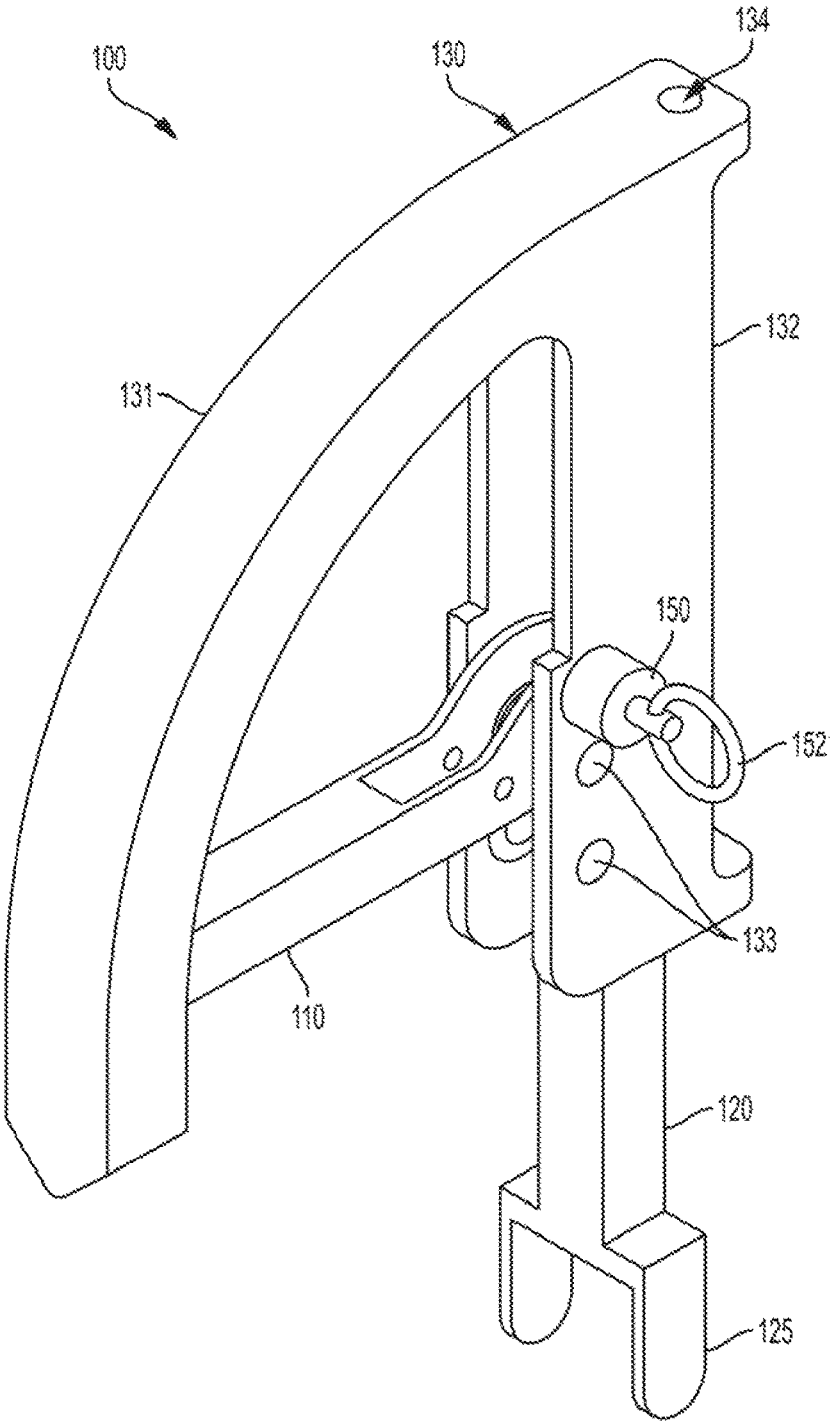
FIG. 3 is an isometric view of a strand grab in accordance with an example embodiment of the disclosed concept.

FIG. 3 is a view of the strand grab 100 in accordance with an example embodiment of the disclosed concept. The strand grab 100 includes a gate member 110, a jaw member 120, a frame 130, and a connector member 140 (shown in FIG. 4).

The frame 130 includes a hook portion 131 and a mounting portion 132. The hook portion 131 has an arced shape that extends in an arcing direction from one of the mounting portion 132. The hook portion 131 is structured to be lifted over the strand 30 and then lowered onto the strand 30, as is shown in FIG. 12. The shape of the hook portion 131 causes the strand 30 to be guided to the top of the hook portion 131 at the intersection of the hook portion 131 and the mounting portion 132.

The mounting portion 132 is structured to couple the frame 130 to the mounting piece 20. The mounting portion 132 includes frame mount pivots 134 formed in its upper and lower ends. The lower frame mount pivot 134 is hidden from view in FIG. 3. The frame mount pivots 134 are used to rotatably attach the frame 130 to the mounting piece 20 so that the strand grab 100 may rotate between the stowed and deployed positions shown in FIGS. 1 and 2. The mounting portion 132 also includes fixed pivots 133 formed through its outer surfaces. The fixed pivots 133 are used to coupled the frame 130 to gate member 110 and the jaw member 120 at corresponding pivots 113,122 (shown in FIG. 4) formed in the gate and jaw members 110,120.

The gate member 110 is an elongated member that extends from one fixed pivot 133 of the mounting portion 132 to proximate the hook portion 131. The gate member 110 is rotatably coupled to the mounting portion 132 so that it can rotate upward from the horizontal position shown in FIG. 3 to the vertical position shown in FIG. 11. When the gate member 110 rotates, its end moves along the shape of the hook portion 131. When the hook portion 131 is lowered onto a strand 30, the strand 30 will push the gate member 110 from its horizontal position to its vertical position.

The jaw member 120 is an elongated member that extends from one fixed pivot 133 of the mounting portion 132 by a length about equal to the gate member 110. The jaw member 120 is rotatably coupled to the mounting portion 132 so that it can rotate upward from its vertical position shown in FIG. 3. The jaw member 120 may continue rotating upward so that it pinches a strand 30 between itself and the gate member 110, as is shown in FIG. 12. In some example embodiments, the jaw member 120 includes a U-shaped end 125. The U-shaped end 125 slides along outside surfaces of the hook portion 131 as the jaw member 120 rotates upward.

The gate member 110 and the jaw member 120 are coupled such that the angle between the gate member 110 and the jaw member 120 cannot exceed about 90°. When the gate member 110 is in its vertical position, the jaw member 120 cannot rotate below the lower end of the hook portion 131. That is, the jaw member 12 cannot rotate below its position shown in FIG. 11. While in the position shown in FIG. 11, even if the strand grab 100 is lifted, it will not release the strand 30.

The strand grab 100 also includes a latch 150. The latch 150 is a spring-loaded plunger that is structured to extend into an engagement hole 111 formed in the gate member 110 when the gate member 110 is in the vertical position shown in FIG. 11. When the latch 150 engages with the gate member 110, the gate member 110 is unable to rotate from the vertical position until the latch 150 releases the gate member 110. To release the gate member 110, the latch 150 is pulled outward so that it disengages the gate member 110 and allows the gate member 110 to rotate from the vertical position. To facilitate pulling out the latch 150, a ring 152 may be attached to an end of the latch 150. The ring 152 may be pulled to pull out the latch 150 and cause it to release the gate member 110. In some example embodiments, a cord may be attached to the ring 152. The cord may extend down the length of the ladder 10 so that a user at the base of the ladder 10 may pull the cord to cause the latch 150 to release the gate member 110. Once the gate member 110 has been released by the latch 150, the gate member 110 can rotate downward from the vertical position allowing the jaw member 120 to rotate downward past the end of the hook portion 131, thus also allowing strand grab 100 to be lifted off of and release a strand 30. When the strand grab 100 is placed on a strand 30, the strand 30 pushes the gate member 110 to the vertical position where it is locked into position by the latch 150. Only the deliberate action of pulling the latch 150 to release the gate member 110 will allow the strand grab 100 to release the strand 30.

Figure 4:
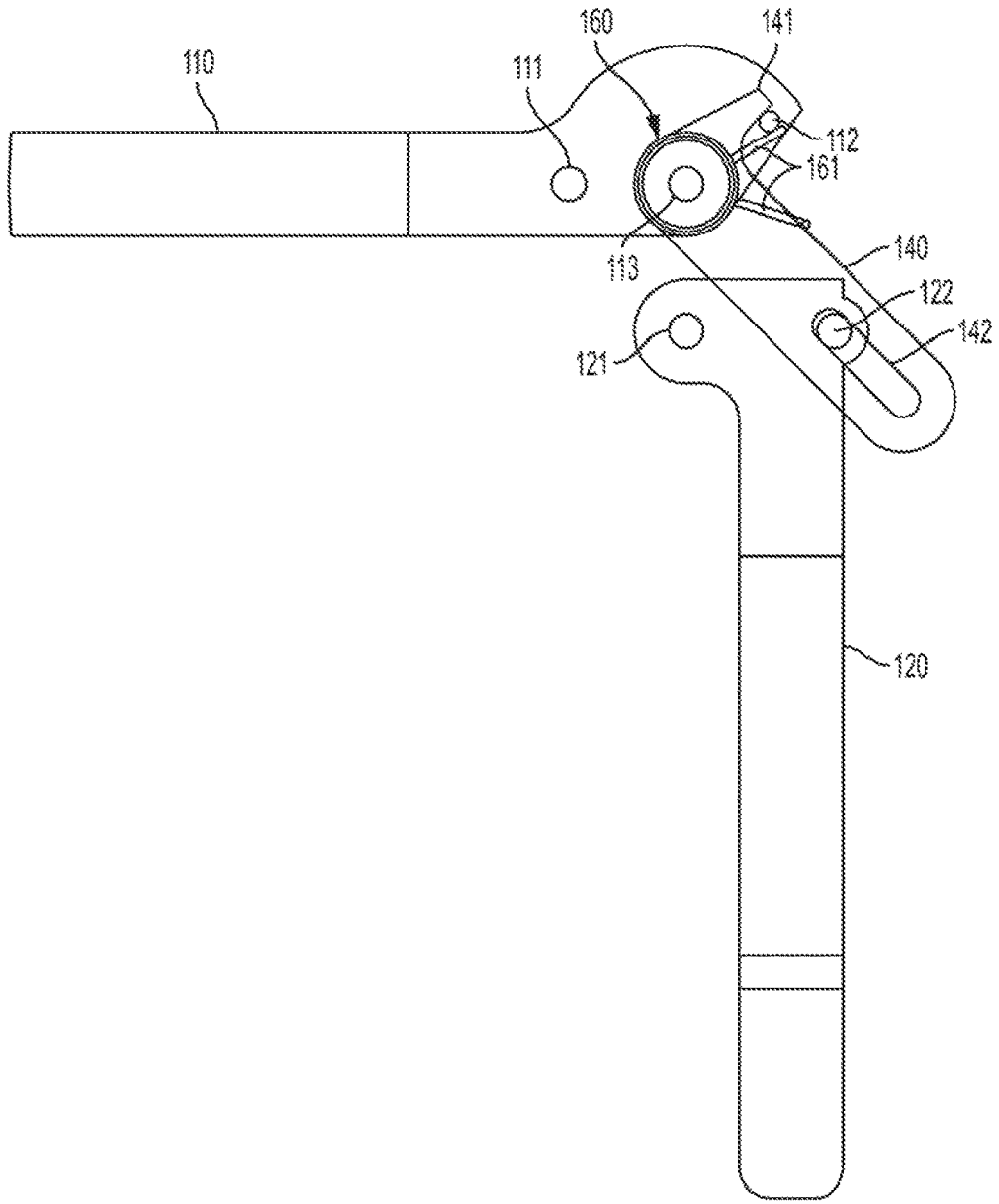
FIG. 4 is an elevation view of a strand grab with the frame hidden in accordance with an example embodiment of the disclosed concept.
Figure 5:
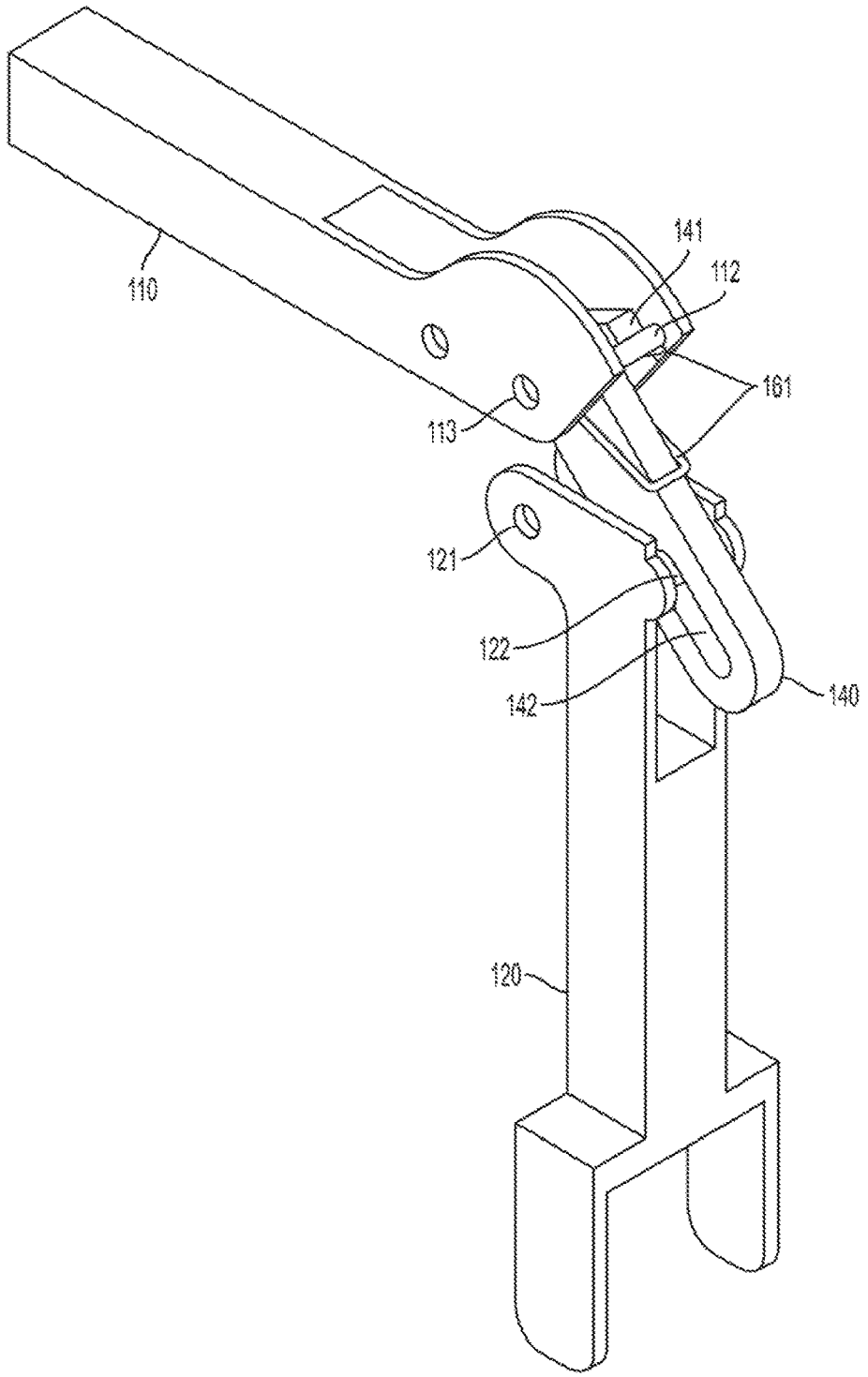
FIG. 5 is an isometric view of a strand grab with the frame hidden in accordance with an example embodiment of the disclosed concept.

FIG. 4 is an elevation view of the strand grab 100 with the frame 130 hidden in accordance with an example embodiment of the disclosed concept and FIG. 5 is an isometric view of the strand grab 100 with the frame 130 hidden in accordance with an example embodiment of the disclosed concept. As shown in FIGS. 4 and 5, the connector member 140 couples the gate member 110 and the jaw member 120.

The connector member 140 is rotatably attached to the gate member 110 at the pivot 113 of the gate member 110. The connector member 140 has a slot 142 formed in it. A slot pin 122 extends from the jaw member 120 into the slot 142 coupling the jaw member 120 to the connector member 140. The jaw member 120 is able to rotate about pivot 121 and the connector member 140 is able to rotate about pivot 113. When the connector member 140 rotates about pivot 113, the side of the slot 142 presses against the slot pin 122. The force against the slot pin 122 by the side of the slot 142 causes the jaw member 120 to rotate about pivot 121. Conversely, when the jaw member 120 is rotated, the slot pin 122 is pressed against the side of the slot 142 which causes the connector member 140 to rotate. When the jaw member 120 rotates, the slot pin 122 moves in a circular path around pivot 121. An effect of the movement of the slot pin 122 around the circular path is that the slot pin 122 moves up or down the slot 142.

The connector member 140 includes stop portion 141. The connector member 140 is elongated and the stop portion 141 extends roughly perpendicular with respect to the elongated direction of the connector member 140. A stop pin 112 extends from the gate member 110. The stop pin 112 is structured to abut against the stop portion 141 of the connector member 140.

A torque spring 160 is disposed around the pivot 113 of the gate member 110. The torque spring 160 includes arms 161, one of which is structured to press against a side of the connector member 140 and another of which is structured to press against the stop pin 112. The torque spring 160 is structured to bias the connector member 140 to rotate in a clockwise direction with respect to the gate member 110 (in the orientation shown in FIG. 4) until the stop portion 141 abuts against the stop pin 112.

Figure 6:
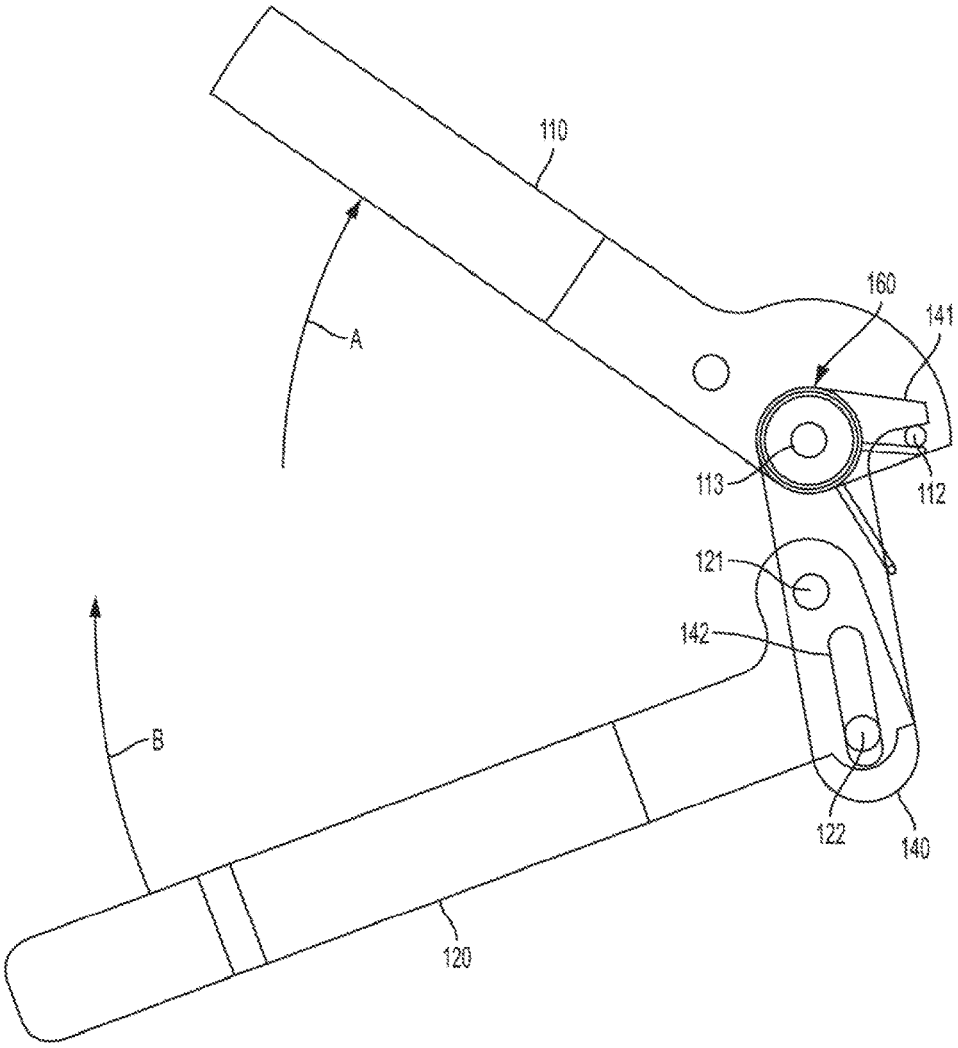
FIG. 6 is an elevation view of a strand grab with the gate member rotating upward in accordance with an example embodiment of the disclosed concept.

FIG. 6 is an elevation view of the strand grab 100 with the frame 130 hidden while the gate member 110 is being rotated upward toward the vertical position in accordance with an example embodiment of the disclosed concept. As shown in FIG. 6, the upward rotational direction of the gate member 110 is designated by the reference character "A". As the gate member 110 rotates upward, the connector member 140 rotates in a clockwise direction along with the gate member 110. The rotation of the connector member 140 is due to the torque spring 160 biasing the connector member 140 so that the stop portion 141 abuts against the stop pin 112. As the gate member 110 rotates, the stop pin 112 moves and the torque spring 160 causes the connector member 140 to rotate with the movement of the stop pin 112 so that that stop portion 141 remains abutted against the stop pin 112.

As the connector member 140 rotates with the gate member 110, the side of the slot 142 is pressed against the slot pin 122 which causes the jaw member 120 to rotate upward about the pivot 121 in the direction designated by the reference character "B". As the jaw member 120 rotates upward, the slot pin 122 slides upward along the slot 142.

Figure 7:
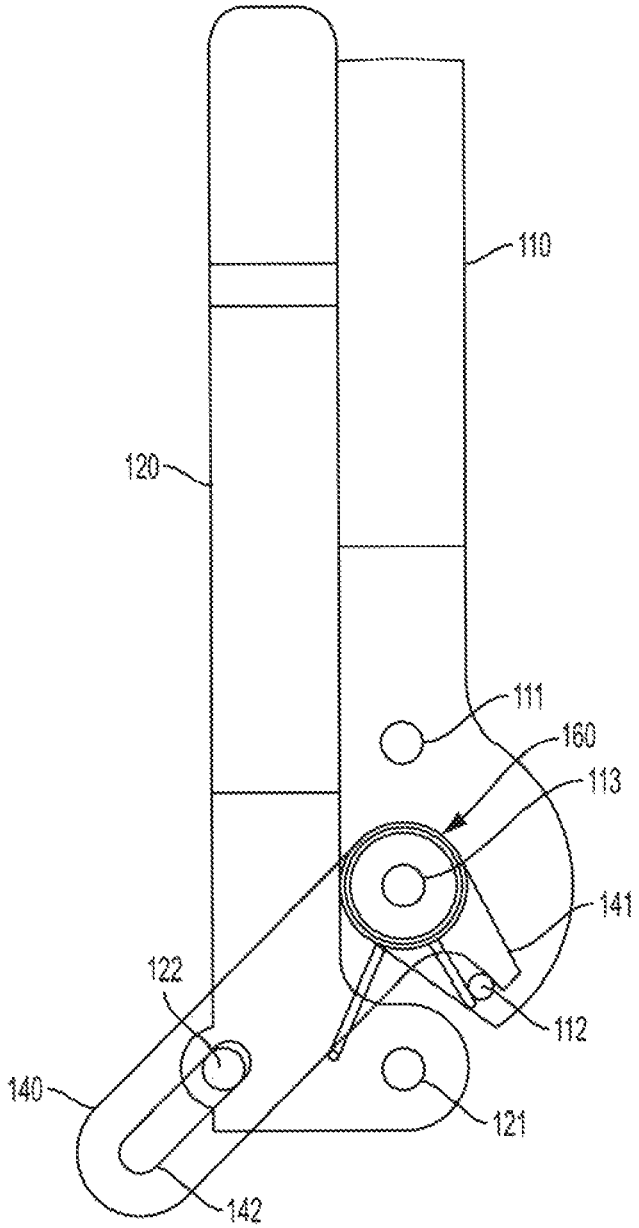
FIG. 7 is an elevation view of a strand grab with the gate member in the vertical position in accordance with an example embodiment of the disclosed concept.

FIG. 7 is an elevation view of the strand grab 100 with the frame 130 hidden and when the gate member 110 has reached the vertical position in accordance with an example embodiment of the disclosed concept. In the vertical position, the latch 150 (shown in FIG. 3) engages with the engagement hole 111 and prevents the gate member 110 from rotating downward. The rotation of the gate member 110 has caused the connector member 140 to continue rotating due to the bias of the torque spring 160. In turn, the rotation of the connector member 140 has continued to press the side of the slot 142 against the slot pin 122 so that the jaw member 120 has continued rotating upward so that it also has a vertical position, as is shown in FIG. 7.

Figure 8:
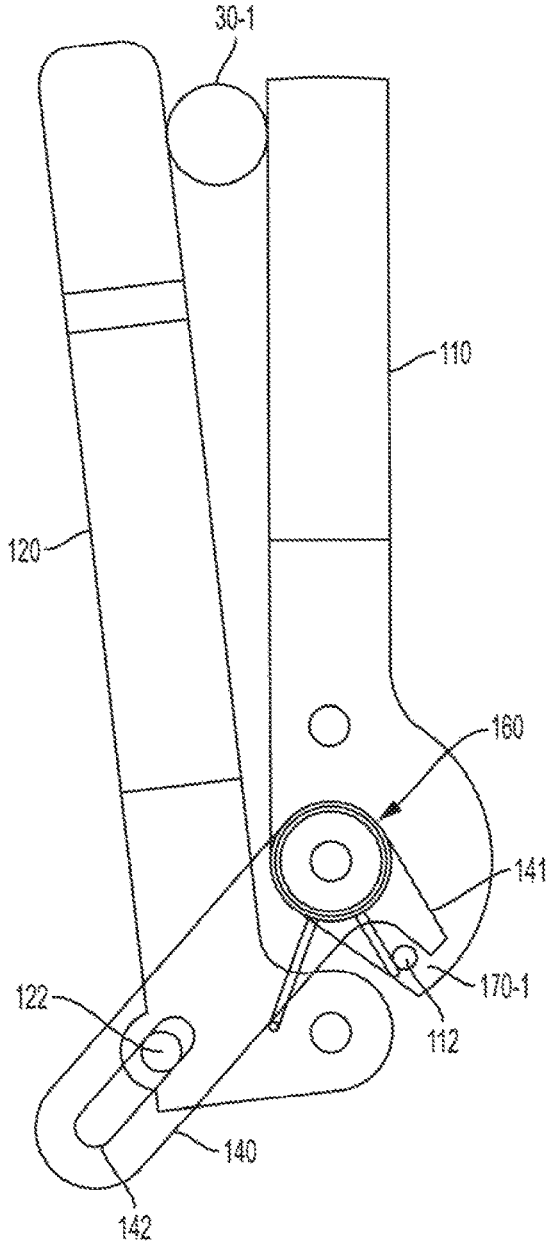
FIG. 8 is an elevation view of a strand grab securing a small diameter strand in accordance with an example embodiment of the disclosed concept.

FIG. 8 is an elevation view of the strand grab 100 with the frame 130 hidden and when the gate member 110 has reached the vertical position with a small diameter strand 30-1 disposed between the gate member 110 and the jaw member 120 in accordance with an example embodiment of the disclosed concept. The position shown in FIG. 8 is the result of lowering the strand grab 100 in the orientation shown in FIG. 3 over the small diameter strand 30-1. When the strand grab 100 is lowered over the small diameter strand 30-1, the small diameter strand 30-1 pushes the gate member 110 to the vertical position. As described with respect to FIGS. 6 and 7, the rotation of the gate member 110 to the vertical position consequently causes the jaw member 120 to also rotate upward.

When the small diameter strand 30-1 is disposed between the gate member 110 and the jaw member 120, as is shown in FIG. 8, the jaw member 120 is unable to fully rotate to the vertical position. Instead, the torque spring 160 continues to bias connector member 140 to rotate in the clockwise direction and the rotational force is transferred to the jaw member 120 via the slot pin 122 and slot 142. The jaw member 140 is thus urged against the small diameter strand 30-1 due to the bias force of the torque spring 160. The amount of force the jaw member 120 applies to the small diameter strand 30-1 is proportional to the torque exerted by the torque spring 160. A gap 170-1 is present between the stop portion 141 and the stop pin 112 due to the small diameter stand 30-1 preventing the jaw member 120 from fully rotating to the vertical position. Since the jaw member 120 is prevented from rotating further towards the vertical position, the connector member 140 is also prevented from continuing to rotate in the clockwise direction. For instance, attempting to rotate the connector member 140 in the clockwise direction presses the side of the slot 142 against the slot pin 122. However, since the slot pin 122 cannot be pressed further to the left, the connector member 140 cannot rotate further in the clockwise direction.

Figure 9:
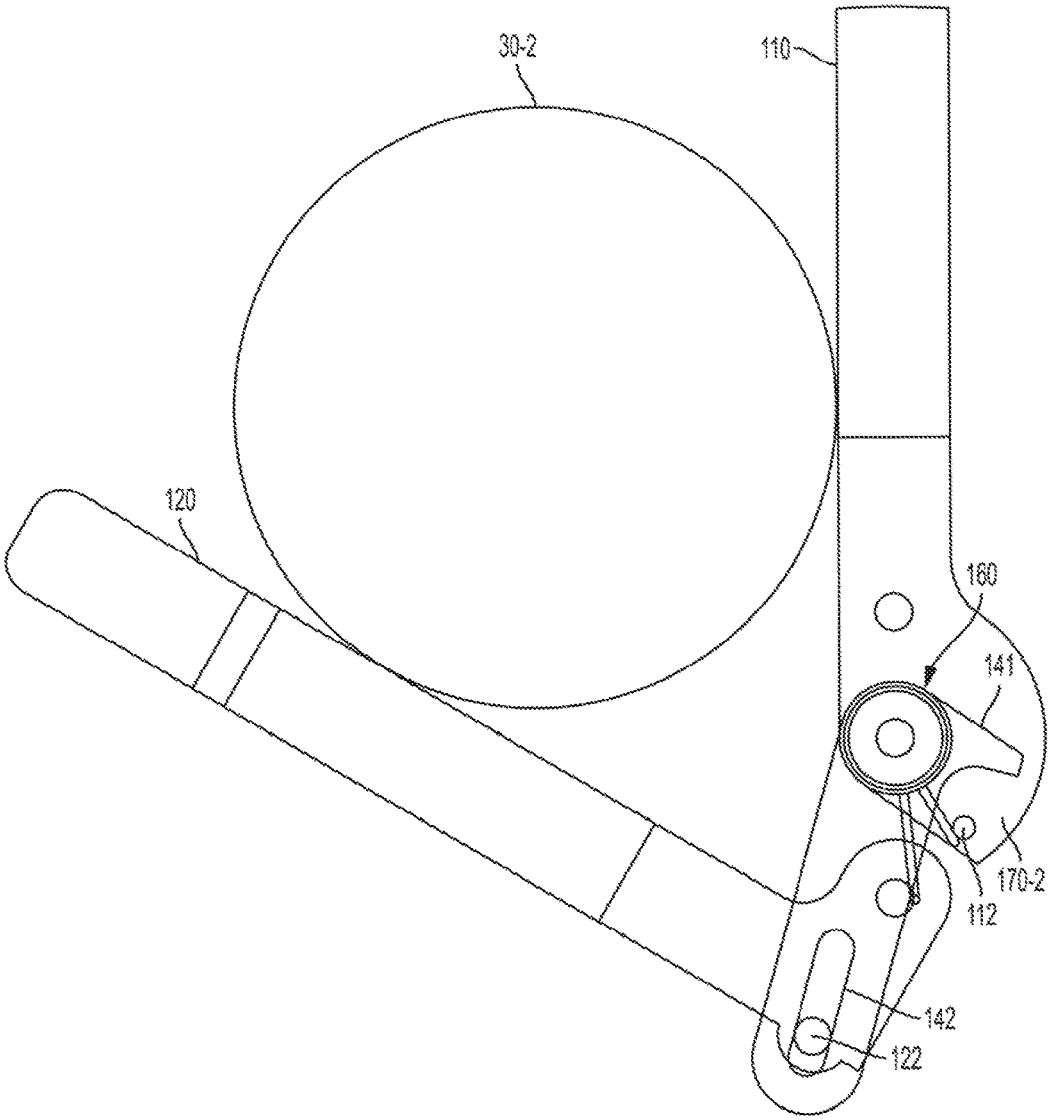
FIG. 9 is an elevation view of a strand grab securing a large diameter strand in accordance with an example embodiment of the disclosed concept.

FIG. 9 is an elevation view of the strand grab 100 with the frame 130 hidden and when the gate member 110 has reached the vertical position with a large diameter strand 30-2 disposed between the gate member 110 and the jaw member 120 in accordance with an example embodiment of the disclosed concept. The operation of the strand grab 100 in FIG. 9 is the same as described above with respect to FIG. 8. However, with the large diameter strand 30-2, the jaw member 120 is not able to rotate upwards as much due to the larger diameter of the large diameter strand 30-2. Thus, the gap 170-2 is also larger and is proportional to the diameter of the strand.

Figure 10:
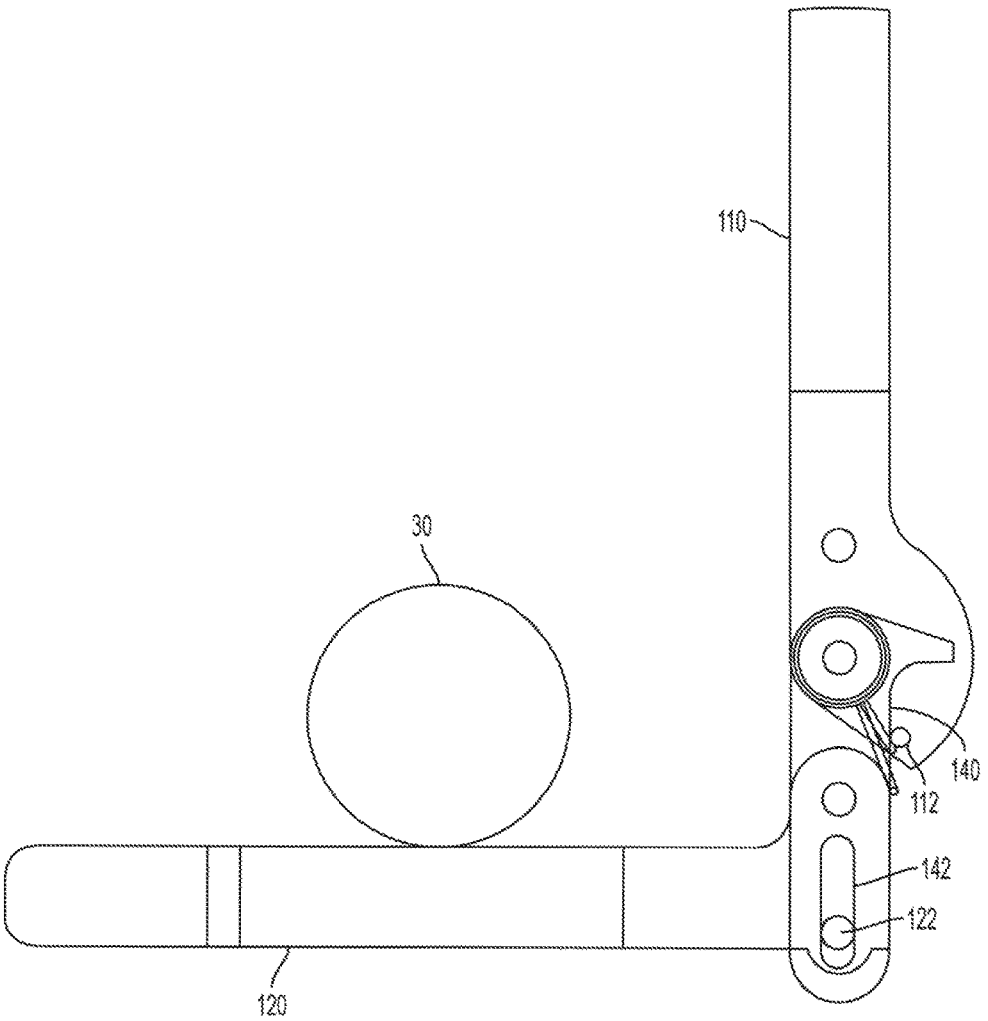
FIG. 10 is an elevation view of a strand grab with the jaw member in a horizontal position and the frame hidden in accordance with an example embodiment of the disclosed concept.

FIG. 10 is an elevation view of the strand grab 100 with the frame 130 hidden and when the gate member 110 has reached the vertical position with a strand 30 attempting to move the jaw member 120 in accordance with an example embodiment of the disclosed concept. In the orientation shown in FIG. 10, the gate member 110 is locked in the vertical position by the latch 150. The strand 30 is applying a downward force on the jaw member 120 such as when the strand grab 100 is being lifted off of the strand 30.

The downward force of the strand 30 causes the jaw member to rotate downward to the horizontal position shown in FIG. 10. However, when the jaw member 120 has reached the horizontal position where it is about at a 90° angle with respect to the gate member 110, the jaw member 120 cannot rotate any further downward. The downward rotation of the jaw member 120 is stopped due to the connector member 140 abutting against the stop pin 112, as is shown in FIG. 10. The downward rotation of the jaw member 120 causes the connector member 140 to rotate counter-clockwise to the position until it abuts against the stop pin 112 and cannot rotate further counter-clockwise. When the connector member 140 cannot rotate counter-clockwise any further, the jaw member 120 cannot rotate downward. In order for the jaw member 120 to rotate further downward, the slot pin 122 would need to be able to push the slot 142 to the right. However, since, the connector member 140 cannot rotate further in the counter-clockwise direction, the slot pin 122 is prevented from moving further to the right and the jaw member 120 is prevented from rotating any further downward.

Figure 11:
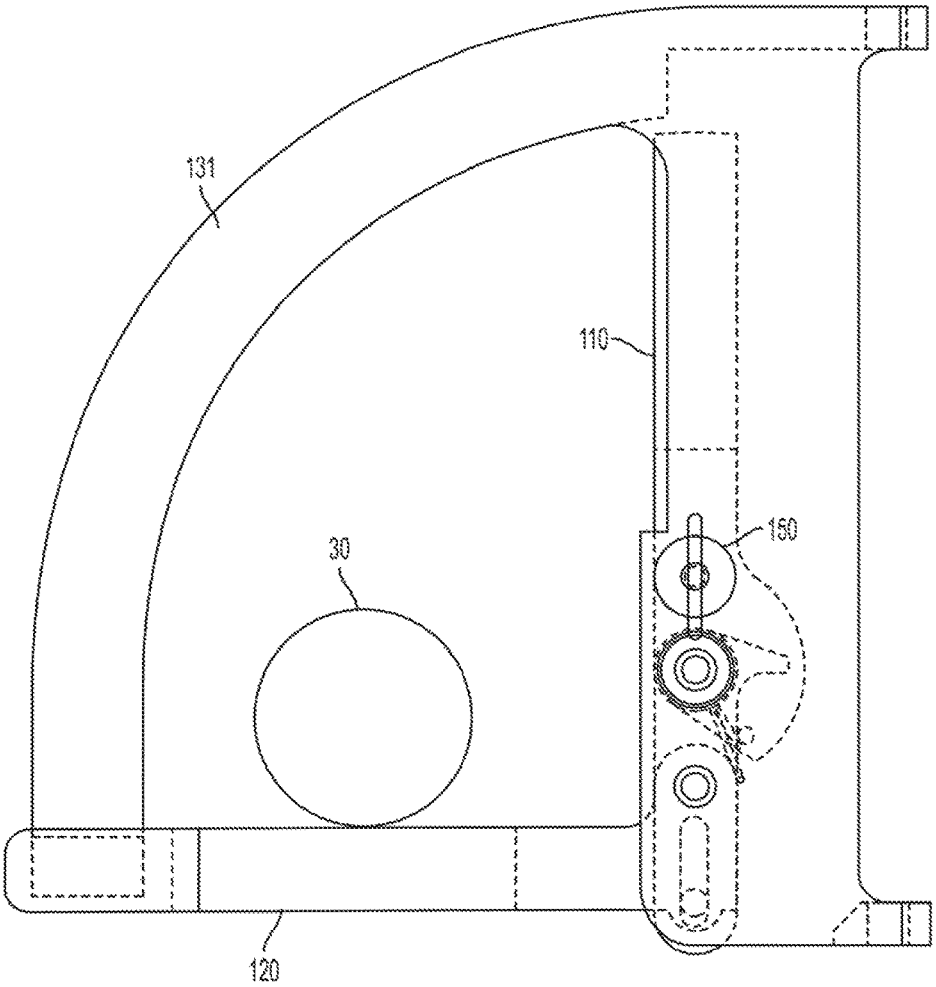
FIG. 11 is an elevation view of a strand grab with the jaw member in a horizontal position and the frame shown in accordance with an example embodiment of the disclosed concept.

FIG. 11 is an elevation view of the strand grab 100 in the orientation shown in FIG. 10 except that the frame 130 is also shown. As shown in FIG. 11, when the jaw member 120 is in the horizontal position, it extends to the bottom end of the hook portion 131. The strand 30 passes through an area defined by the hook portion 131, the gate member 110, and the jaw member 120. As the jaw member 120 cannot rotate any further downward until the latch 150 releases the gate member 110, the strand 30 cannot pass by the jaw member 120 and be released from the strand grab 100 until the latch 150 is operated to release the gate member 110.

FIG. 12 is an isometric view of the strand grab 100 secured to a strand 30 in accordance with an example embodiment of the disclosed concept. To secure the strand grab 100 to the strand grab 100 begins in the orientation shown in FIG. 1 with the gate member 110 in the horizontal position. The ladder 10 is lifted so that strand grab 100 is over the strand 30 and then the ladder 10 is lowered so the strand grab 100 is lowered onto the strand 30. The lowering motion causes the strand 30 to push the gate member 110 to the vertical position where the latch 150 automatically latches the gate member 110 into the vertical position. As previously described, the jaw member 120 also rotates upward with the gate member 110 so that the jaw member 120 is pinched against the strand 30 as shown in FIG. 12. The force of the jaw member 120 against the strand 30 prevents the strand grab 100 from sliding along the strand 30. Also, the strand grab 100 will remain secured to the strand 30 until the latch 150 is deliberately released, thus preventing any accidental release of the strand grab 100 from the strand 30.

Figure 13:
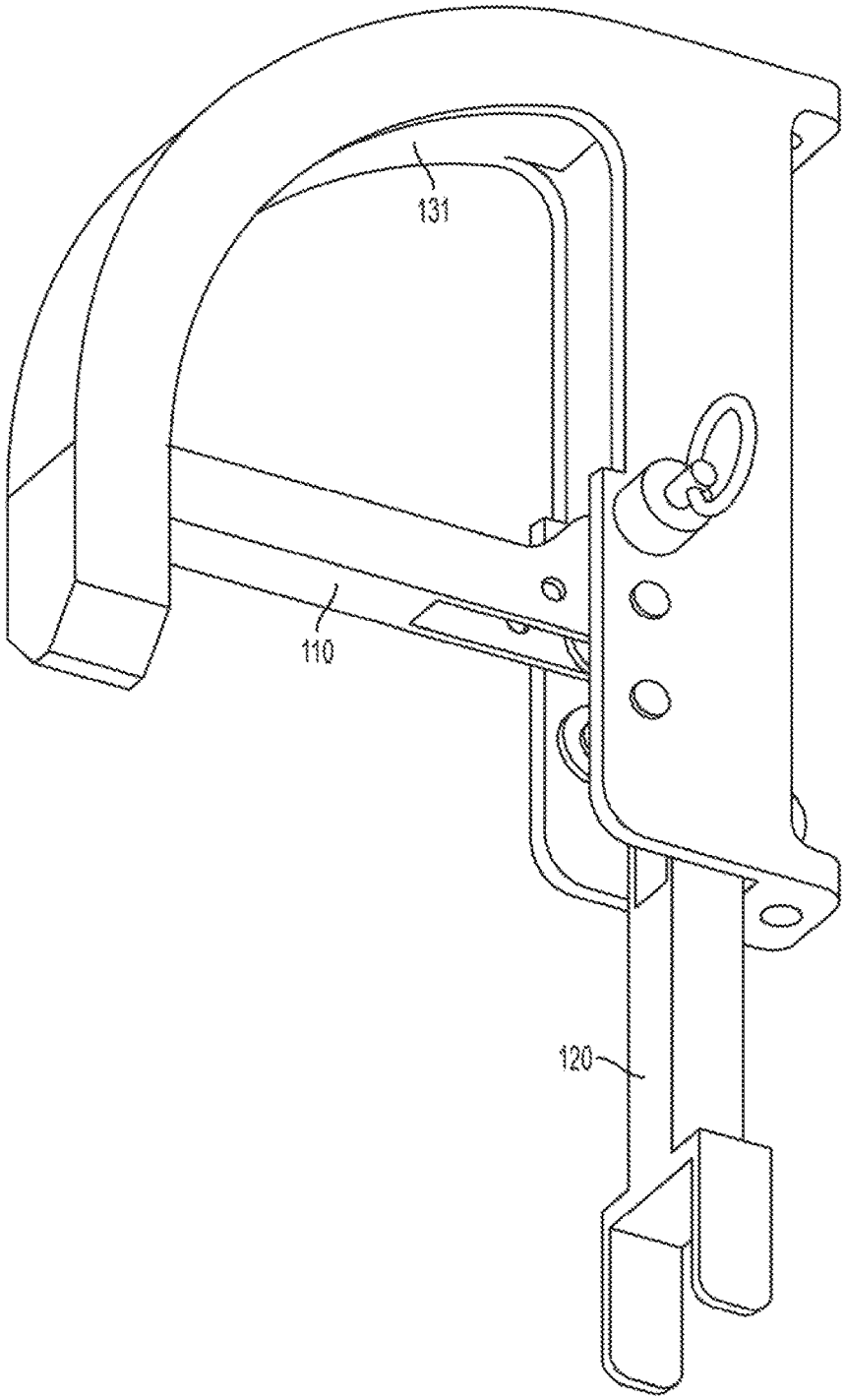
FIG. 13 is an isometric view of a strand grab in accordance with an example embodiment of the disclosed concept.

FIG. 13 is another view of the strand grab 100 in accordance with an example embodiment of the disclosed concept. In some example embodiments of the disclosed concept, the top side of the jaw member 120, the bottom side of the gate member 110, and the bottom side of the hook portion 131 may be covered with a resilient material such as, without limitation, rubber, in order to prevent damage to the strand 30 as well as to increase the coefficient of friction between the components of the strand grab 100 and the strand 30. The increased coefficient of friction assists in preventing the strand grab 100 from sliding along the strand 30 when it is secured to the strand 30.

Figure 14:
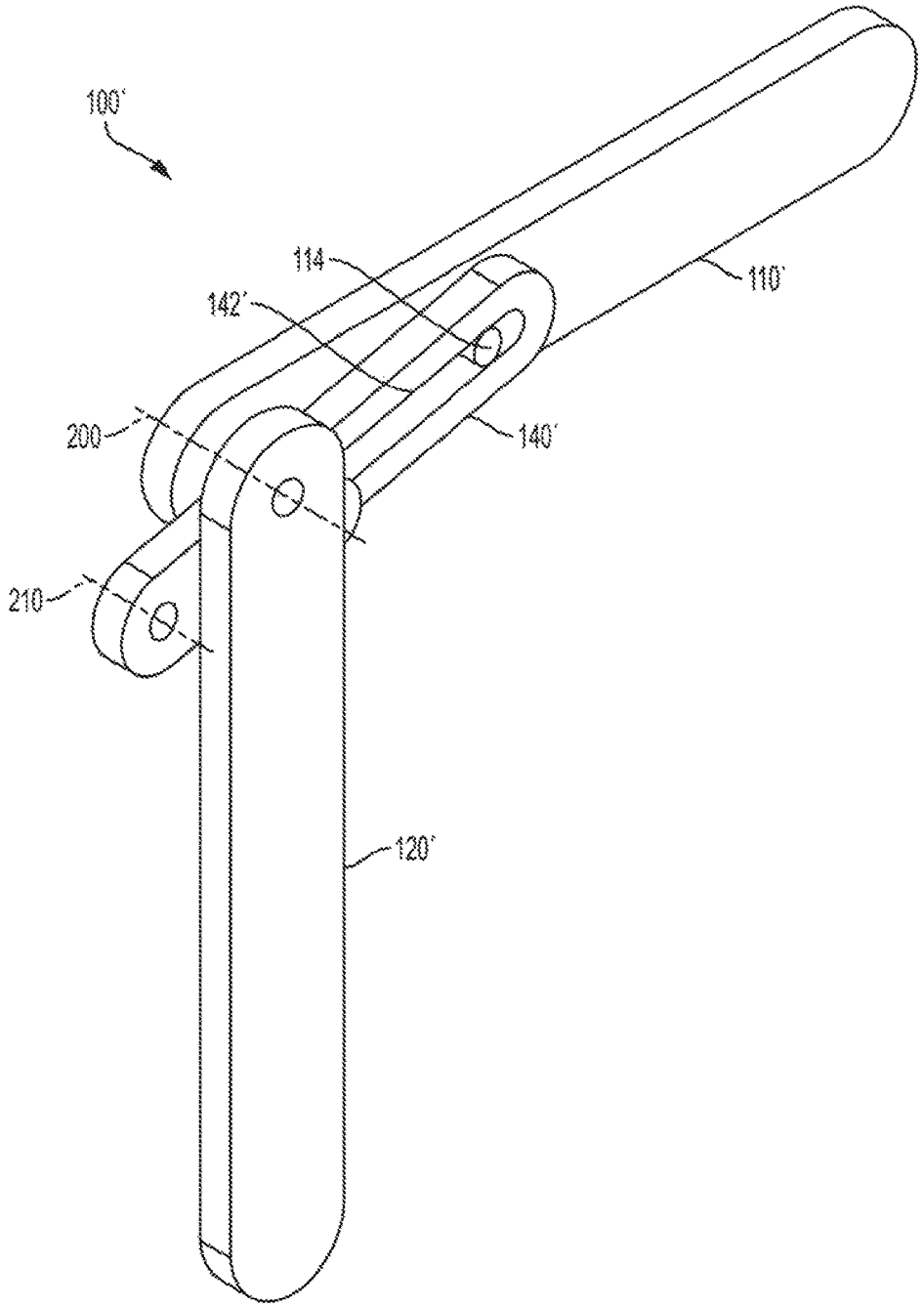
FIG. 14 is an isometric view of an alternative strand grab in accordance with an example embodiment of the disclosed concept.
Figure 15:
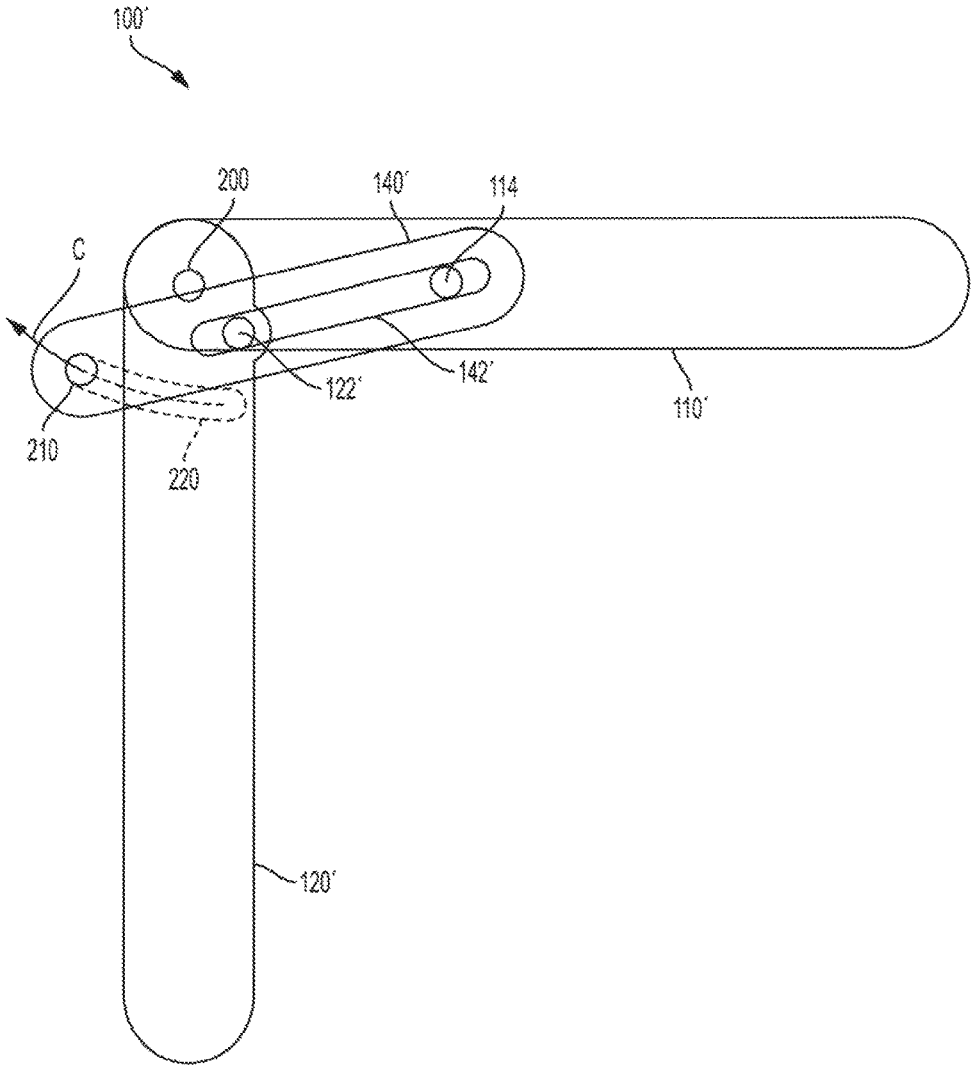
FIG. 15 is an elevation view of the alternative strand grab of FIG. 14 in accordance with an example embodiment of the disclosed concept.

FIG. 14 is a view of a strand grab 100' in accordance with an example embodiment of the disclosed concept and FIG. 15 is a side view of the strand grab of FIG. 14. The strand grab 100' of FIG. 14 is an alternative arrangement to the strand grab 100 of FIG. 1. It will be understood that a frame similar to the frame 130 shown in FIG. 3 may be used in conjunction with the strand grab 100' of FIG. 14. However, the frame is hidden from view in FIG. 14 to better illustrate and explain the operation of the components.

The strand grab 100' includes a gate member 110', a jaw member 120', and a connector member 140'. The gate member 110' and jaw member 120' are elongated members that share a common pivot axis 200. The gate member 110 and the jaw member 120' are able to rotate about the pivot axis 200. The connector member 140' has a pivot 210. The connector member 140' is able to rotate about the pivot 210. The pivot 210 of connector member 140' is also able to slide along a frame slot 220 (shown in FIG. 15). The frame slot 220 is a slot formed on an interior surface of the frame. For example and without limitation, the frame 130 of FIG. 3 may be modified such that the frame slot 220 is formed on one of its interior surfaces and it may be employed with the strand grab 100' of FIG. 14. The frame slot 220 has an arc shape such as that shown in FIG. 15. The strand grab 100' includes a spring (not shown) that biases the connector pivot 210 toward the left end (e.g., in the direction designated by reference character "C" in FIG. 15) of the frame slot 220.

The connector member 140' includes a slot 142'. Gate member 110' includes a gate slot pin 114 and jaw member 120' includes a jaw slot pin 122'. The gate member 110' and the jaw member 120' are coupled to the connector member 140' by the gate slot pin 114 and the jaw slot pin 122' extending into the slot 142'. The gate slot pin 114 and the jaw slot pint 122' are both configured to slide along the slot 142'. Rotating the gate member 110' or the jaw member 120' causes the corresponding slot pin 114,122' to press against the side of the slot 142' and rotate the connector member 140'. Conversely, rotating the connector member 140' causes the side of the slot 142' to press against the gate slot pin 114 and the jaw slot pin 122', thus causing the gate member 110' and the jaw member 120' to rotate. For example, rotating the gate member 110' upward causes the gate slot pin 114 to press against an upper side of the slot 142' and rotate the connector member 140'. The rotation of the connector member 140' in turn causes the bottom side of the slot 142' to press upward against the jaw slot pin 122' and cause the jaw member 120' to also rotate upward. Thus, the gate member 110' and the jaw member 120' rotate together.

Figure 16:
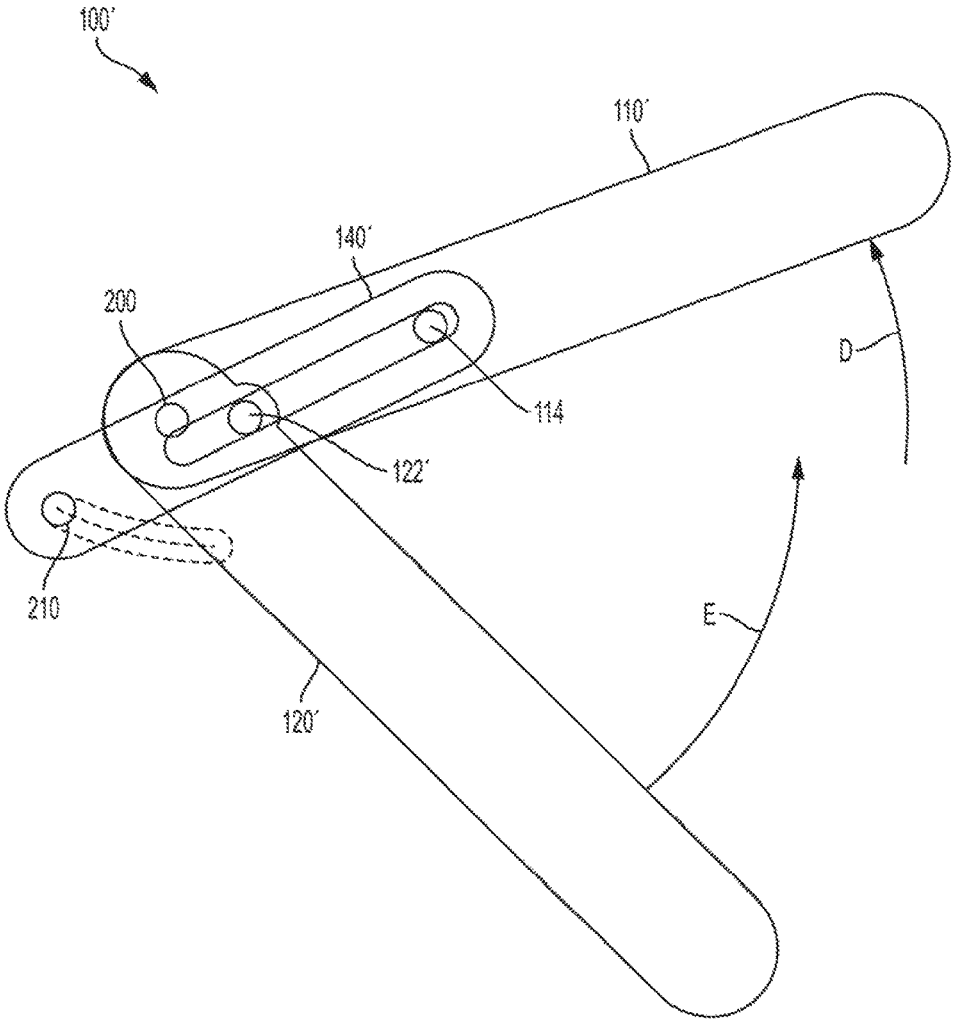
FIG. 16 is an elevation view of an alternative strand grab while the gate member rotates upward in accordance with an example embodiment of the disclosed concept.

FIG. 16 is an elevation view of the strand grab 100' while the gate member 110' is rotating upward in accordance with an example embodiment of the disclosed concept. As shown in FIG. 16, as the gate member 110' rotates upward in the direction designated by reference character "D", the jaw member 120' follows the gate member 110' upward in the direction designated by reference character "E".

Figure 17:
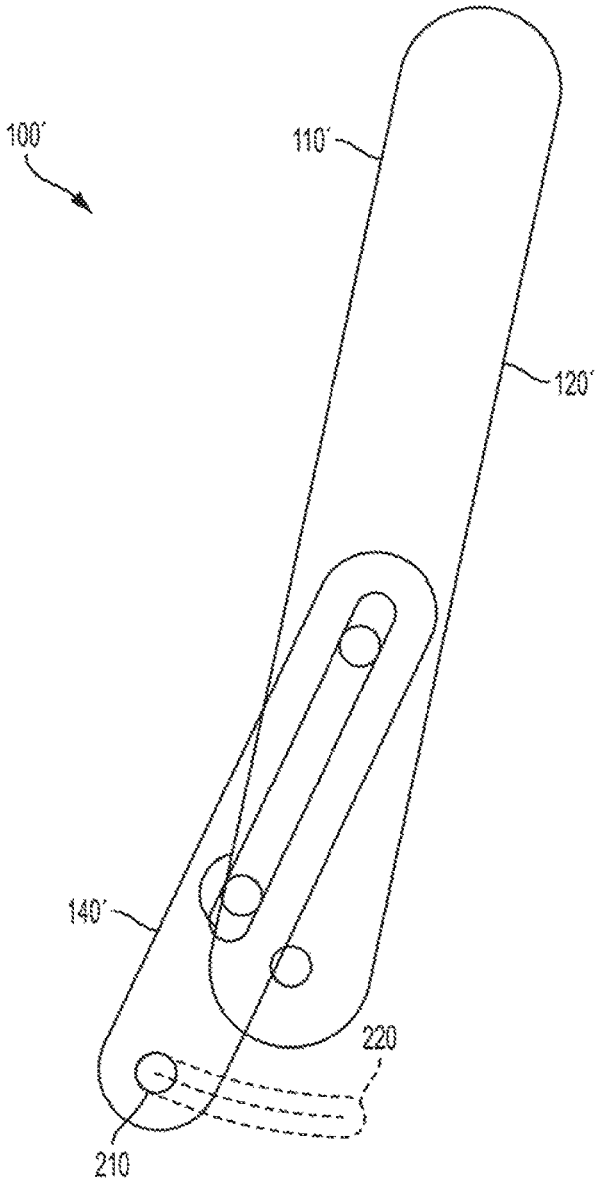
FIG. 17 is an elevation view of an alternative strand grab while the gate member is in the vertical position in accordance with an example embodiment of the disclosed concept.

FIG. 17 is an elevation view of the strand grab 100' when the gate member 110' has reached its vertical position in accordance with an example embodiment of the disclosed concept. The jaw member 120' has followed the gate member 110' in upward rotation and has also reached a vertical position. In the vertical position, the gate member 110' is latched in the vertical position by a latch such as the latch 150 of FIG. 3. Although details such as the engagement hole 111 are not shown in FIG. 17, it will be appreciated that the strand grab 100' may include features such as the engagement hole 111 and latch 150 so as to enable a latching operation similar to that previously described with respect to FIG. 3.

It is noted that in the examples shown in FIGS. 15, 16, and 17, the pivot 210 of the connector member 140' has remained on the left side of the frame slot 220 due to the spring biasing it in that position. However, the presence of a strand 30 between the gate member 110' and the jaw member 120' will cause the pivot 210 to slide from the left side of the frame slot 220, as will be described with respect to FIG. 18.

Figure 18:
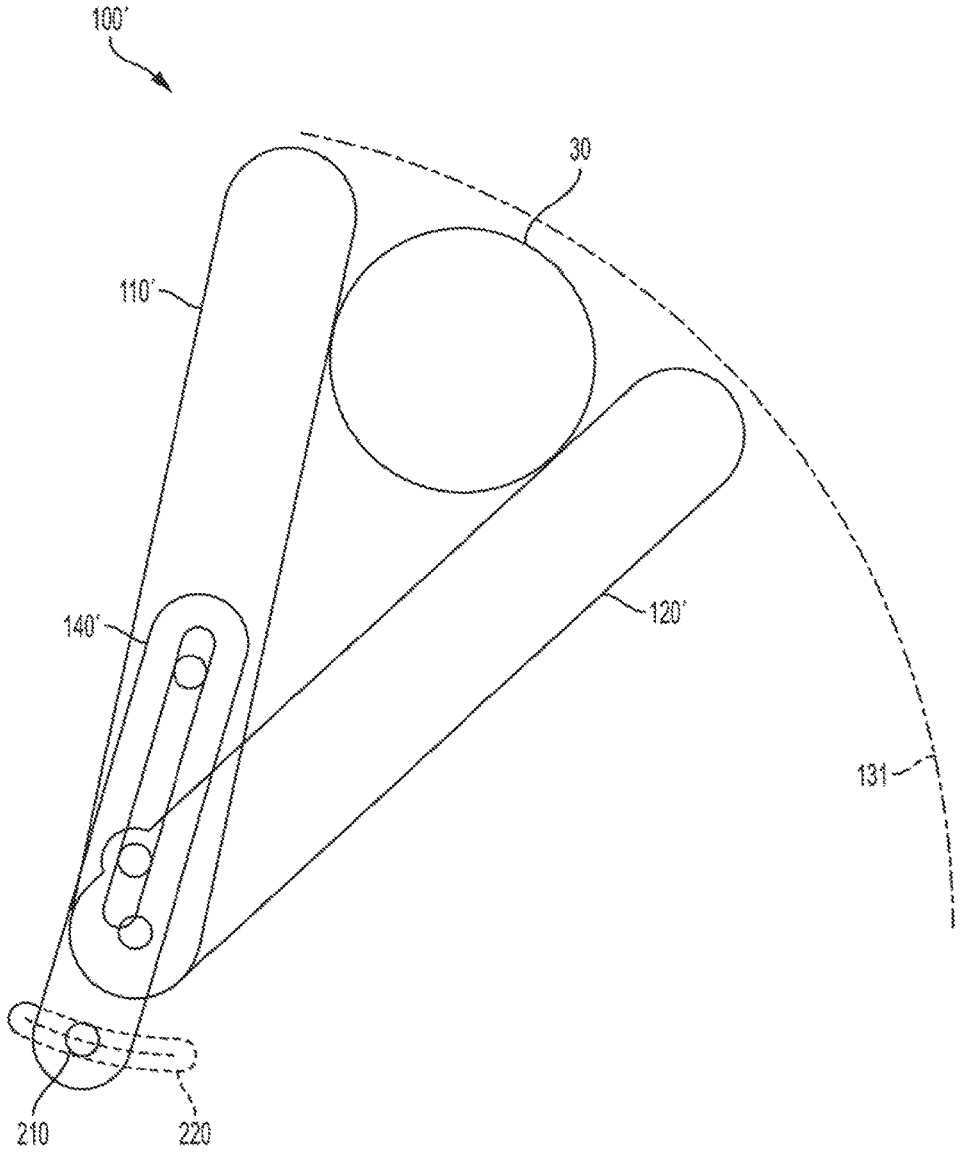
FIG. 18 is an elevation view of an alternative strand grab securing a strand in accordance with an example embodiment of the disclosed concept.

FIG. 18 is an elevation view of the strand grab 100' securing a strand 30 in accordance with an example embodiment of the disclosed concept. The strand 30 is disposed between the gate member 110' and the jaw member 120'. When the strand grab 100' is lowered onto the strand 30, the strand 30 will push the gate member 110' to the vertical position. The jaw member 120 follows the rotation of the gate member 110' upward. As the gate member 110' reaches the vertical position the jaw member 120' pinches the strand 30 between the gate and jaw members 110',120'. As the jaw member 120' cannot reach the vertical position due to the strand 30, the offset between the jaw member 120' and the gate member 110' forces the pivot 210 of the connector member 140 to slide right along the frame slot 220 to accommodate the offset between the gate and jaw members 110',120'. The bias force of the spring pushing the pivot 210 to the left of the frame slot 220 is translated to a force pinching the jaw member 120' against the strand 30.

Figure 19:
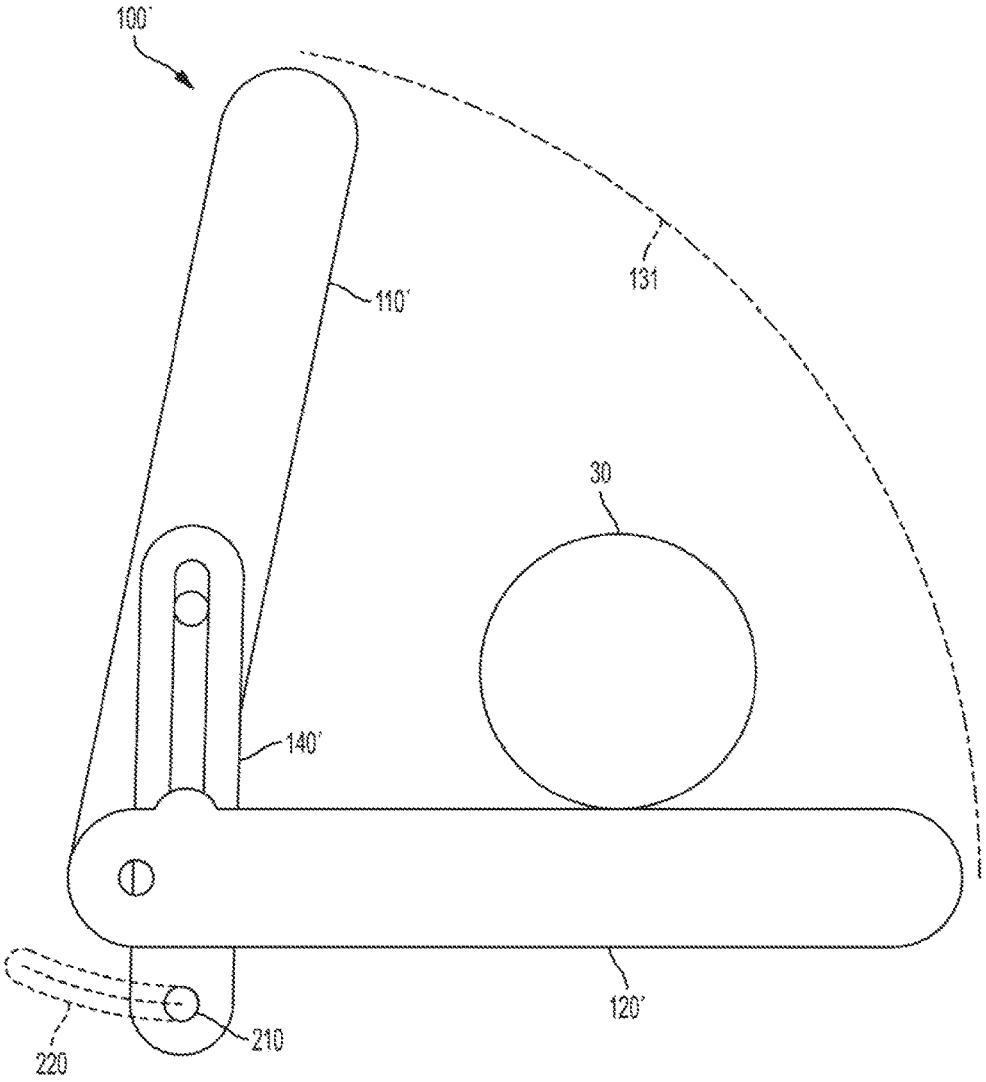
FIG. 19 is an elevation view of an alternative strand grab with a strand pushing down the jaw member in accordance with an example embodiment of the disclosed concept.

FIG. 19 is an elevation view of the strand grab 100' while the strand 30 is pushing the jaw member 120' downward in accordance with an example embodiment of the disclosed concept. The jaw member 120' may be pushed downward, for example, if the strand grab 100' is attempted to be lifted off of the strand 30. As the jaw member 120' is pushed downward, the offset between the gate member 110' and the jaw member 120' increases, thus forcing the pivot 210 of the connector member 140' to slide further to the right of the frame slot 220. The length of the frame slot 220 is selected such that the pivot 210 will reach the right end of the frame slot 220 when the jaw member 120' is at the bottom end of the hook portion 131 of the frame 130. When the pivot 210 reaches the right end of the frame slot 220, the pivot 210 can not move any further to the right and, in turn, the jaw member 120' is prevented from rotating further downward. The strand 30 will remain secured until the gate member 110' is unlatched so that it and the jaw member 120' can rotate further downward.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An apparatus for use with a ladder, the apparatus comprising:

a frame including a mounting portion and a hook portion having a first end attached to the mounting portion and extending in an arc shape to a second end;

a gate member rotatably attached to the mounting portion of the frame at a first pivot;

a jaw member rotatably attached to the mounting portion of the frame at a second pivot; and a connector member coupled between the gate member and the jaw member, wherein the gate member is rotatable between a first position proximate the second end of the hook portion and a second position proximate the first end of the hook portion, wherein the gate member is structured to rotate from the first position toward the first end of the hook portion when the strand grab is lowered onto a strand such that the strand applies a force against the gate member, and wherein the gate member, the jaw member, and the connector member are operatively coupled such that when the gate member rotates toward the first end of the hook portion, the connector member causes the jaw member to rotate toward the first end of the hook portion.

2. The apparatus of claim 1, further comprising:

a latch attached to the frame, wherein the gate member includes an engagement hole, and wherein the latch is structured to engage with the engagement hole when the gate member is in the second position to latch the gate member into the second position.

3. The apparatus of claim 2, wherein the latch is spring loaded and is structured to automatically engage and latch the gate member in the second position when the gate member reaches the second position, and wherein the latch member is structured to release the gate member from the second position when the latch is pulled away from the frame.

4. The apparatus of claim 1, further comprising:

a spring structured to bias the connector member to rotate with respect to the gate member.

5. The apparatus of claim 4, wherein the gate member includes a stop pin and the connector member includes a stop portion, wherein the stop pin is structured to abut against the stop portion to stop rotation of the connector member with respect to the gate member, and wherein the spring is structured to bias the connector member to rotate such that the stop portion abuts against the stop pin.

6. The apparatus of claim 5, wherein the connector member includes a slot and the jaw member includes a slot pin that extends into the slot and is structured to slide along the slot, and wherein rotation of the connector member causes a side of the slot to press against the slot pin and cause the jaw member to rotate.

7. The apparatus of claim 6, wherein the spring is structured to bias the connector member to rotate in a direction with respect to the gate member that biases the jaw member to rotate toward the gate member.

8. The apparatus of claim 7, wherein the jaw member is structured to rotate away from the gate member when a force sufficient to overcome the bias of the spring is applied to the jaw member.

9. The apparatus of claim 8, wherein when the jaw member is rotated away from the gate member such that an angle between the jaw member and the gate member is about 90°, the stop pin is structured to abut against the connector member and prevent the jaw member from rotating further away from the gate member.

10. The apparatus of claim 4, wherein the spring is a torque spring disposed about the first pivot, and wherein the torque spring includes a first arm structured to apply a first bias against the connector member and a second arm structured to apply a second bias against the stop pin.

11. The apparatus of claim 1, wherein the connector member includes a slot, wherein the gate member includes a gate slot pin that extends into the slot, and wherein the jaw member includes a jaw slot pin that extends into the slot.

12. The apparatus of claim 11, wherein rotation of the gate member toward the first end of the hook portion is structured to cause the gate slot pin to press against an upper side of the slot and cause the connector member to rotate, and wherein upward rotation of the connector member is structured to cause a bottom side of the slot to press against the jaw slot pin and cause the jaw member to rotate.

13. The apparatus of claim 12, wherein the frame includes a frame slot formed therein, wherein the connector member includes a connector pivot that extends into the frame slot, wherein the connector member is structured to rotate about connector pivot, and wherein the connector pivot is structured to slide along the frame slot.

14. The apparatus of claim 13, further comprising:

a spring structured to bias the connector pivot toward a first end of the frame slot.

15. The apparatus of claim 14, wherein the connector pivot is structured to slide away from the first end of the frame slot when a force is applied to the jaw member to rotate the jaw member away from the gate member.

16. The apparatus of claim 15, wherein when the jaw member is rotated away from the gate member such that an angle between the jaw member and the gate member is about 90°, the connector pivot is structured to abut against a second end of the frame slot and prevent the jaw member from rotating further away from the gate member.

17. A ladder comprising:

a pair of rails;

a pair of rungs extending between the rails;

a mounting piece attached between the pair of rungs; and an apparatus rotatably attached to the mounting piece, the apparatus including:

a frame including a mounting portion and a hook portion having a first end attached to the mounting portion and extending in an arc shape to a second end;

a gate member rotatably attached to the mounting portion of the frame at a first pivot;

a jaw member rotatably attached to the mounting portion of the frame at a second pivot;

a connector member coupled between the gate member and the jaw member, wherein the gate member is rotatable between a first position proximate the second end of the hook portion and a second position proximate the first end of the hook portion, wherein the gate member is structured to rotate from the first position toward the first end of the hook portion when the apparatus is lowered onto a strand such that the strand applies a force against the gate member, and wherein the gate member, the jaw member, and the connector member are operatively coupled such that when the gate member rotates toward the first end of the hook portion, the connector member causes the jaw member to rotate toward the first end of the hook portion.

18. The ladder of claim 17, wherein the apparatus is rotatable between a stowed position and a deployed position, wherein, in the stowed position, the apparatus does not extend beyond a width of the rails.

19. The ladder of claim 17, wherein the mounting portion includes a pair of mounting pivots structured to couple the apparatus to the mounting piece.

* * * * *